US006715333B2

(12) United States Patent
Liang

(10) Patent No.: US 6,715,333 B2
(45) Date of Patent: Apr. 6, 2004

(54) CUTTING AND CRIMPING DEVICE

(76) Inventor: William Wei Guo Liang, Unit 23, 5840 Dover Crescent, Richmond, B.C. (CA), V7C 5P4

( * ) Notice: Subject to any disclaimer, the term of this patent is extended or adjusted under 35 U.S.C. 154(b) by 0 days.

(21) Appl. No.: 10/098,552

(22) Filed: Mar. 18, 2002

(65) Prior Publication Data

US 2003/0172705 A1 Sep. 18, 2003

(51) Int. Cl.[7] ..... B21D 7/00; B21D 41/04

(52) U.S. Cl. ..... 72/324; 72/453.16; 29/564.6; 7/158

(58) Field of Search ..... 72/324, 409.01, 72/409.12, 409.19, 453.16; 29/566.1, 566.4, 564.6, 751; 7/158; 30/228

(56) References Cited

U.S. PATENT DOCUMENTS

| | | | | | |
|---|---|---|---|---|---|
| 3,040,606 | A | * | 6/1962 | Ericsson | 81/313 |
| 3,220,241 | A | * | 11/1965 | Miller | 72/446 |
| 3,333,607 | A | * | 8/1967 | Haraden | 140/93.2 |
| 3,706,245 | A | | 12/1972 | Van Schaik | 81/301 |
| 3,769,859 | A | * | 11/1973 | Sykes et al. | 140/150 |
| 3,804,132 | A | * | 4/1974 | Mann | 140/106 |
| 4,558,584 | A | | 12/1985 | Myers | 72/324 |
| 4,574,417 | A | * | 3/1986 | Magnasco | 30/172 |
| 4,730,476 | A | | 3/1988 | Lindberg et al. | 72/324 |
| 4,794,780 | A | | 1/1989 | Battenfeld | 29/751 |
| 4,998,351 | A | | 3/1991 | Hartmeister | 72/409.01 |
| 5,063,770 | A | * | 11/1991 | Chen | 72/409.11 |
| 5,207,014 | A | * | 5/1993 | Panella | 7/158 |
| 5,599,227 | A | * | 2/1997 | Vary | 30/228 |

* cited by examiner

*Primary Examiner*—Daniel C. Crane
(74) *Attorney, Agent, or Firm*—Oyen Wiggs Green & Mutala

(57) ABSTRACT

A cutting and crimping device comprising a frame with a front end and a back end, the frame comprising a protrusion on the front end, the protrusion having a first crimping portion and a first cutting portion on opposed sides thereof, a cutting arm with a front end and a back end, the cutting arm pivotally coupled to the frame on one side thereof, the cutting arm comprising a second cutting portion on its front end, a crimping arm with a front end and a back end, the crimping arm pivotally coupled to the frame on an opposite side thereof, the crimping arm comprising a second crimping portion on its front end, an actuator coupled to the back ends of the cutting and crimping arms, the actuator operable to move the cutting and crimping device between an open position wherein the front ends of the arms are separated from the protrusion by a maximum distance, and a closed position wherein the front ends of the cutting and crimping arms are separated from the protrusion by a lesser distance.

15 Claims, 4 Drawing Sheets

CUTTING AND CRIMPING DEVICE

TECHNICAL FIELD

The present invention pertains to devices for cutting and crimping cables, and more particularly to devices which can make straight cuts and proper crimps at a work site.

BACKGROUND

In many situations where cables, also known as "wire ropes", are used, the cables must be cut at a work site, and two or more sections of cable must be crimped together. Crimping is generally accomplished by inserting the ends of two or more cables into a deformable cylindrical housing known as a "sleeve". The sleeve is then crimped by crushing the sleeve tightly against the cables contained therein. A large amount of force is required both to cut the cables and to crimp the sleeve around two or more cable sections to join them together.

There exist prior art devices that can be used to both cut cables and crimp two or more sections of cable together. For example, U.S. Pat. No. 4,558,584 discloses a combination cable crimper and cutter with a pair of crimping jaws that are urged together by a piston. A cutter is mounted on one of the crimping jaws opposite a cutter anvil on the side of the frame.

One problem with such prior art devices is that in both cutting and crimping operations, particularly in applications such as logging where the cables are wrapped around an irregularly shaped bundle of logs, the cables must be cut or crimped at a point where they are flush against a surface. As one skilled in the art will appreciate, a device similar to that disclosed in U.S. Pat. No. 4,558,584 that has the cutter on the side is not well suited for cutting cables that are flush against a surface.

Another problem with prior art cutting and crimping devices is that it can be difficult to keep the device properly oriented with respect to the cable during cutting and crimping. In order to achieve a straight cut the cutting blades of a cutter must be placed, by the user, in the correct position relative to the cable. Likewise, in order to achieve a proper crimp the crimping portions of a crimper must be placed, by the user, in the correct position relative to the sleeve and cables therein.

There exists a need for cutting and crimping devices which are well suited for cutting cables that are flush against a surface, and which facilitate proper orientation with respect to the cable during cutting and crimping.

SUMMARY OF INVENTION

The invention provides a cutting and crimping device comprising a frame with a front end and a back end, the frame comprising a protrusion on the front end, the protrusion having a first crimping portion and a first cutting portion on opposed sides thereof, a cutting arm with a front end and a back end, the cutting arm pivotally coupled to the frame on one side thereof, the cutting arm comprising a second cutting portion on its front end, a crimping arm with a front end and a back end, the crimping arm pivotally coupled to the frame on an opposite side thereof, the crimping arm comprising a second crimping portion on its front end, and, an actuator coupled to the back ends of the cutting and crimping arms, the actuator operable to move the cutting and crimping device between an open position wherein the front ends of the arms are separated from the protrusion by a maximum distance, and a closed position wherein the front ends of the cutting and crimping arms are separated from the protrusion by a lesser distance.

The actuator may comprise a push rod having a front end and a back end, and a block, with the block attached to the front end of the push rod. The actuator may be coupled to the back end of the cutting arm by a cutting arm link, with a back end of the cutting arm link being pivotally attached to the block, and a front end of the cutting arm link being pivotally attached to the back end of the cutting arm. The actuator may be coupled to the back end of the crimping arm by a crimping arm link, with a back end of the crimping arm link being pivotally attached to the block, and a front end of the crimping arm link being pivotally attached to the back end of the crimping arm. The cutting arm link may be longer than the crimping arm link.

The second cutting portion may comprise a reversible cutting blade. The protrusion may comprise a recess sized slightly larger than the first cutting portion, and the first cutting portion comprises a cutting edge opposite a rounded edge, with the rounded edge positioned in the recess.

The first and second crimping portions may comprise rounded notches.

The cutting and crimping device may further comprise a drive means connected to the back end of the push rod, the drive means operable to urge the push rod forward.

The cutting and crimping device may further comprise a handlebar attached to the frame.

The cutting and crimping device may further comprise a grip attached to the frame. The grip may comprise a control button operable to control the drive means.

The actuator may further comprise a plate attached to the back end of the push rod, and may even further comprise a spring between the plate and the frame, the spring biasing the cutting and crimping device to the open position.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
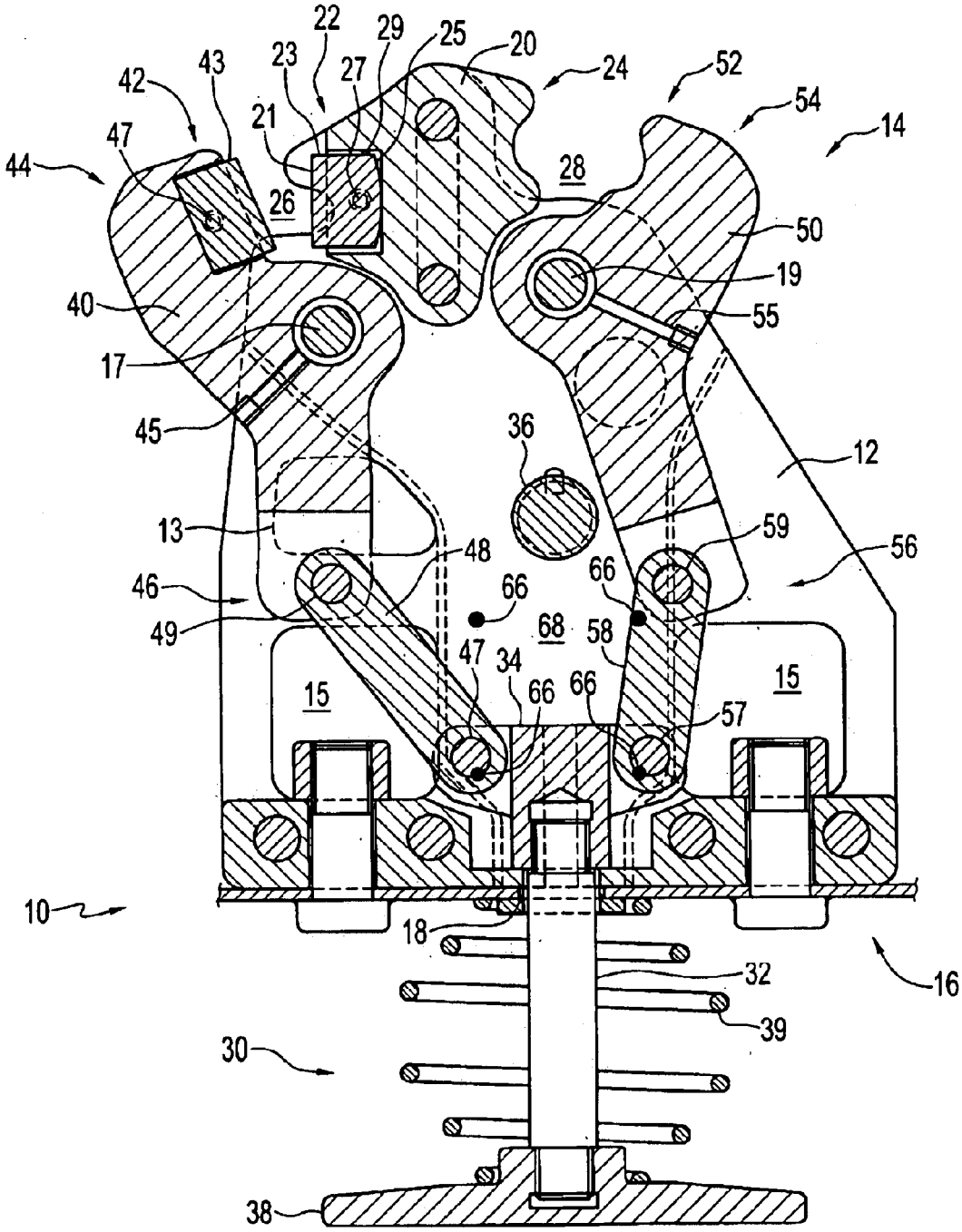
FIG. 1 shows a longitudinal sectional view of a cutting and crimping device according to a preferred embodiment of the invention, in an open position.

FIG. 1 shows a cutting and crimping device 10 according to a preferred embodiment of the invention. Cutting and crimping device 10 comprises frame 12 with front end 14 and back end 16. Frame 12 is tapered towards front end 14, and defines window 13 near front end 14, in order to reduce the overall weight of cutting and crimping device 10. Frame 12 further defines square windows 15 near back end 16.

Square windows 15 not only serve to reduce the overall weight of cutting and crimping device 10, but also facilitate maintenance and servicing of cutting and crimping device 10, as described below. Frame 12 may further comprise threaded holes 66 on flat portion 68, as described below with reference to FIG. 4.

Frame 12 comprises protrusion 20 at front end 14. Protrusion 20 comprises cutting portion 22 on one side thereof, and crimping portion 24 on an opposite side thereof. An actuator 30 is operably connected to back end 16.

Throughout the description "forward" means the direction from actuator 30 is connected, towards protrusion 20. The "cutting side" means the side of cutting and crimping device 10 on which cutting portion 22 of protrusion 20 is located, and the "crimping side" means the side of cutting and crimping device 10 on which crimping portion 24 of protrusion 20 is located.

Cutting arm 40 is pivotally attached to frame 12 on the cutting side at a position between front end 14 and back end 16 by pivot bolt 17. The precise position at which cutting arm 40 is attached to frame 12 will depend on the expected primary use of cutting and crimping device 10. The larger the diameter of a typical cable which cutting and crimping device 10 will be expected to be used to cut, the farther back the position at which cutting arm 40 is attached to frame 12 should be.

Cutting arm 40 comprises cutting portion 42 on front end 44 thereof. Cutting recess 26 is defined between cutting portion 42 on front end 44 of cutting arm 40 and cutting portion 22 on protrusion 20. Cutting arm 40 may optionally comprise lubrication channel 45 for lubricating its pivotal coupling with frame 12. Back end 46 of cutting arm 40 is coupled to be driven by actuator 30, as described below.

Cutting portions 22 and 42 preferably comprise cutting blades 23 and 43, respectively. Cutting blade 23 preferably comprises cutting edge 21 and rounded edge 25. Cutting blade 23 is secured to protrusion 20 by pin 27, and is located within recess 29. Recess 29 is sized larger than cutting blade 23 to provide room for cutting blade 23 to pivot slightly about pin 27, which allows for improved cutting of cables, as described below. Cutting blade 43 is attached to front end 44 of cutting arm 40 by pin 47. Cutting blade 43 is preferably reversible so that when one cutting edge is worn out the user can flip cutting blade 43 over and use a fresh cutting edge.

Crimping arm 50 is pivotally attached to frame 12 on the crimping side at a position between front end 14 and back end 16 by pivot bolt 19. The precise position at which crimping arm 50 is attached to frame 12 will depend on the expected primary use of cutting and crimping device 10. The larger the diameter of a typical sleeve which cutting and crimping device 10 will be used to crimp, the farther back the position where crimping arm 50 is attached to frame 12 should be. Crimping arm 50 comprises crimping portion 52 on front end 54 thereof. Crimping recess 28 is defined between crimping portion 52 on front end 54 of crimping arm 50 and crimping portion 24 on protrusion 20. Crimping arm 50 may optionally comprise lubrication channel 55 for lubricating its pivotal coupling with frame 12. Back end 56 of crimping arm 50 is coupled to be driven by actuator 30, as described below.

Crimping portions 24 and 52 preferably comprise rounded notches. Preferably the notches have a curvature which is similar to the curvature of a sleeve of the size expected to be crimped.

In the embodiment shown in FIG. 1, actuator 30 comprises push rod 32 with block 34 attached to the front thereof. Frame 12 defines aperture 18 in the back thereof, through which push rod 32 is slidably inserted. Aperture 18 is not large enough to allow block 34 to pass therethrough, so that push rod 32 and block 34 are retained within frame 12. Frame 12 has stop bolt 36 through a central portion thereof. Stop bolt 36 is located directly in front of aperture 18, so that when push rod 32 is pushed forward, block 34 will abut stop bolt 36. The range of motion of actuator 30 is thereby constrained between a rearward or "open" position (FIG. 1) wherein block 34 abuts the back of frame 12 adjacent aperture 18, and a forward or "closed" position (FIG. 2) wherein block 34 abuts stop bolt 36. In the FIG. 1 embodiment, actuator 30 further comprises plate 38 attached to the back of push rod 32. Spring 39 is positioned between frame 12 and plate 38 to bias cutting and crimping device 10 towards the open position.

Cutting arm 40 is coupled to actuator 30 by cutting arm link 48. One end of cutting arm link 48 is pivotally attached to the cutting side of block 34 by first cutting link pin 47, and the other end of cutting arm link 48 is pivotally attached to the back end 46 of cutting arm 40 by second cutting link pin 49. Likewise, crimping arm 50 is coupled to actuator 30 by crimping arm link 58. One end of crimping arm link 58 is pivotally attached to the crimping side of block 34 by first crimping link pin 57, and the other end of crimping arm link 58 is pivotally attached to the back end 56 of crimping arm 50 by second crimping link pin 59. In the preferred embodiment shown in FIGS. 1 and 2, cutting arm link 48 is longer than crimping arm link 58, in order to allow crimping recess 28 to be directly in front of push rod 32. Crimping recess 28 is preferably in line with push rod 32 to provide added force and stability while crimping, as crimping generally requires more force than cutting.

Preferably, both cutting arm 40 and crimping arm 50 may be removed or replaced without fully dismantling cutting and crimping device 10. To remove cutting arm 40, a user removes pivot bolt 17 which extends through frame 12. Second cutting link pin 49 may be removed by positioning cutting arm link 48 appropriately with respect to square window 15 on the cutting side of cutting and crimping device. To remove crimping arm 50, a user removes pivot bolt 19 which extends through frame 12. Second crimping link pin 59 may be removed by positioning crimping arm link 58 appropriately with respect to square window 15 on the crimping side of cutting and crimping device.

In operation, cutting and crimping device 10 begins in an open position, as shown in FIG. 1. In the open position, actuator 30 is in its rearward position, with block 34 abutting the back of frame 12 adjacent aperture 18. In the open position, back ends 46 and 56 of cutting arm 40 and crimping arm 50 are held, by cutting arm link 48 and crimping arm link 58, respectively, at a position wherein their separation from stop bolt 36 is at a minimum. Accordingly, in the open position, the separation between cutting portion 42 on front end 44 of cutting arm 40 and cutting portion 22 on protrusion 20, and the separation between crimping portion 52 on front end 54 of crimping arm 50 and crimping portion 24 on protrusion 20 are at a maximum.

When cutting and crimping device 10 is in the open position, cutting recess 26 may be positioned to cut a cable by placing cutting portion 22 of protrusion 20 against the cable, or crimping recess 28 may be positioned to crimp a sleeve containing two or more sections of cable by placing crimping portion 24 of protrusion 20 against the sleeve, or both. Once the cable or sleeve or both are in place, cutting and crimping device 10 may be moved toward a closed position as shown in FIG. 2 by urging push rod 32 forward with a suitable drive means 60 (see FIG. 3).

Figure 2:
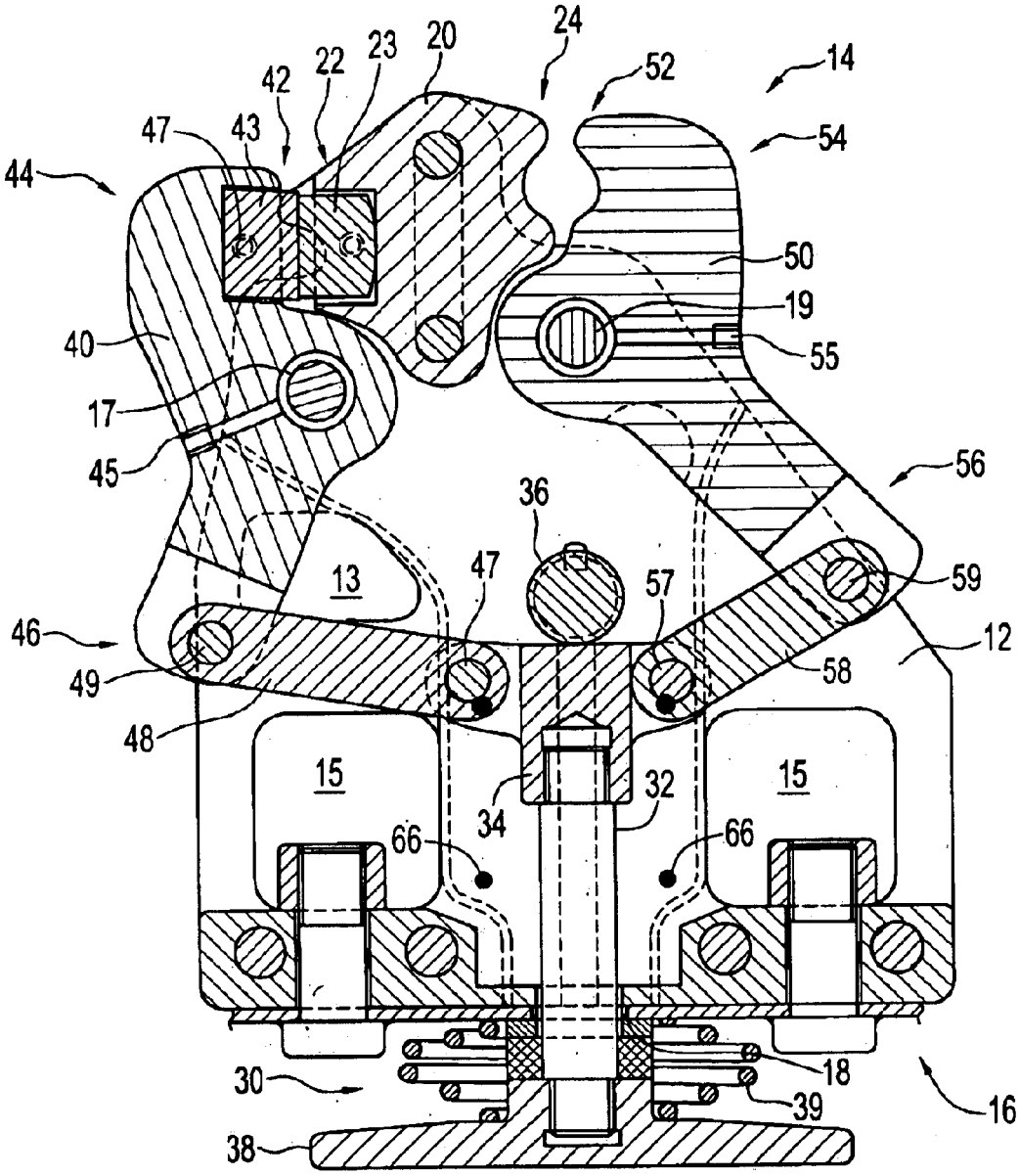
FIG. 2 shows the cutting and crimping device of FIG. 1 in a closed position.

If a cable is positioned in cutting recess 26 as cutting and crimping device 10 moves toward the closed position shown in FIG. 2, cutting blades 23 and 43 will cut the cable. Cutting blade 23 has room to pivot slightly in recess 29, as described above, so that cutting blades 23 and 43 may be parallel at the end of the cutting stroke. This reduces unraveling of the cut ends of the cable, which can make it difficult for the ends to be fit into a sleeve. Preferably, once the cutting stroke is complete and cutting and crimping device 10 is in the closed position, cutting blades 23 and 43 will be separated by a distance of less then 1 mm, and more preferably by a distance of approximately 0.2 mm.

As one skilled in the art will appreciate, since cutting portion 22 and crimping portion 24 on protrusion 20 remain stationary as push rod 32 is urged forward, there is less potential for user error than in prior art cutting and crimping devices where there are two moving parts which must be aligned with the cables. Stationary protrusion 20 makes it possible for a user to simply rest the appropriate portion (cutting or crimping) of protrusion 20 against the cable or cables to be cut or crimped, and activate the drive means. There is no need to balance the device so that the cable or cables are separated from each of two moving parts by an equal distance. This makes it easier for a user to achieve even crimping, wherein a single sleeve is crimped at a number of evenly spaced locations, which results in a stronger joining of the sections of cables within the sleeve.

Figure 3:
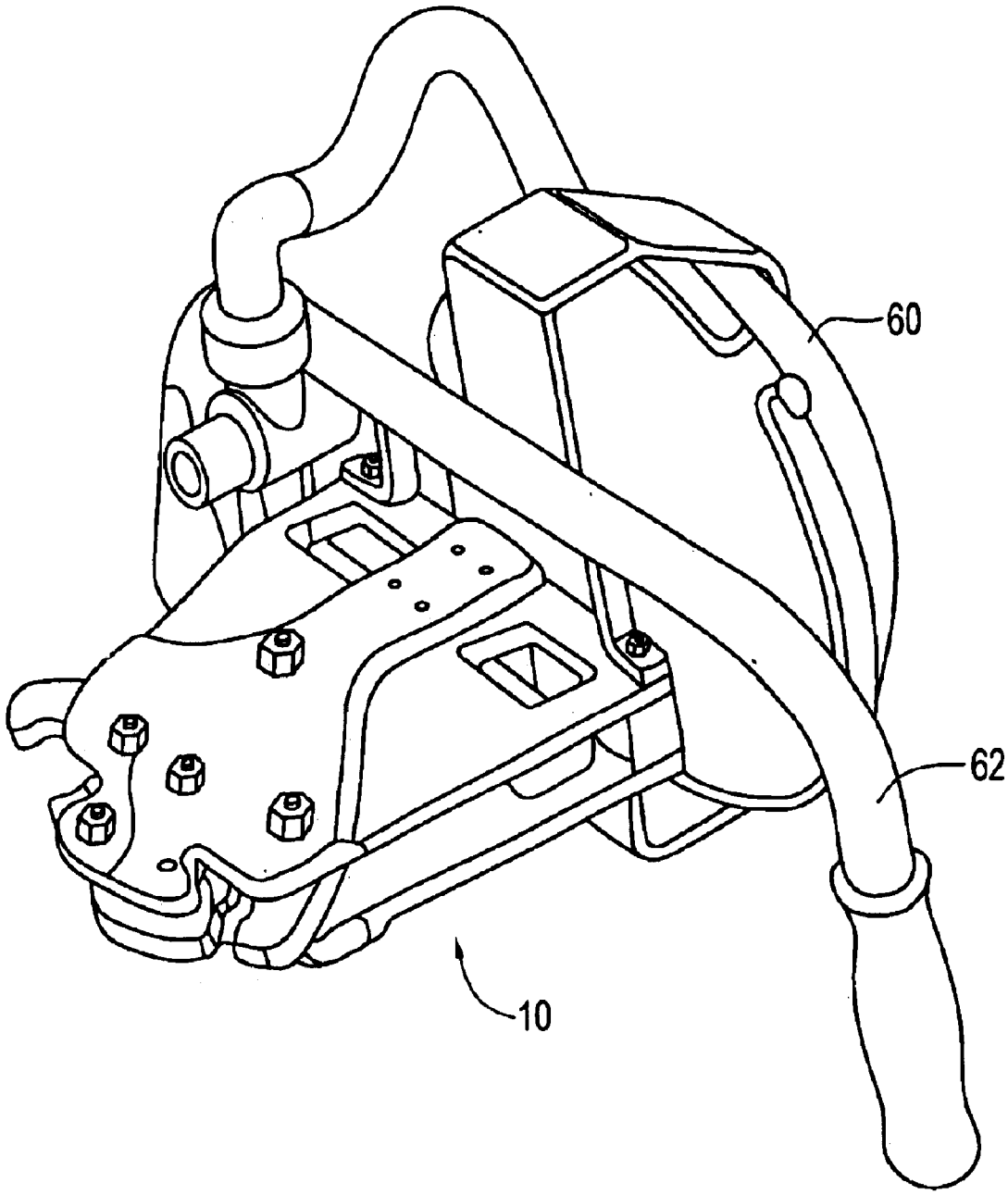
FIG. 3 shows a perspective view of the cutting and crimping device of FIG. 1 coupled to a drive means.

FIG. 3 shows cutting and crimping device 10 with drive means 60 coupled to the back thereof. Handlebar 62 may be attached to cutting and crimping device 10 to facilitate operation of cutting and crimping device 10 by a user. Drive means 60 may comprise a hydraulic cylinder, a pneumatic cylinder coupled to an air compressor, or any other apparatus capable of urging push rod 32 forward with sufficient force.

Figure 4:
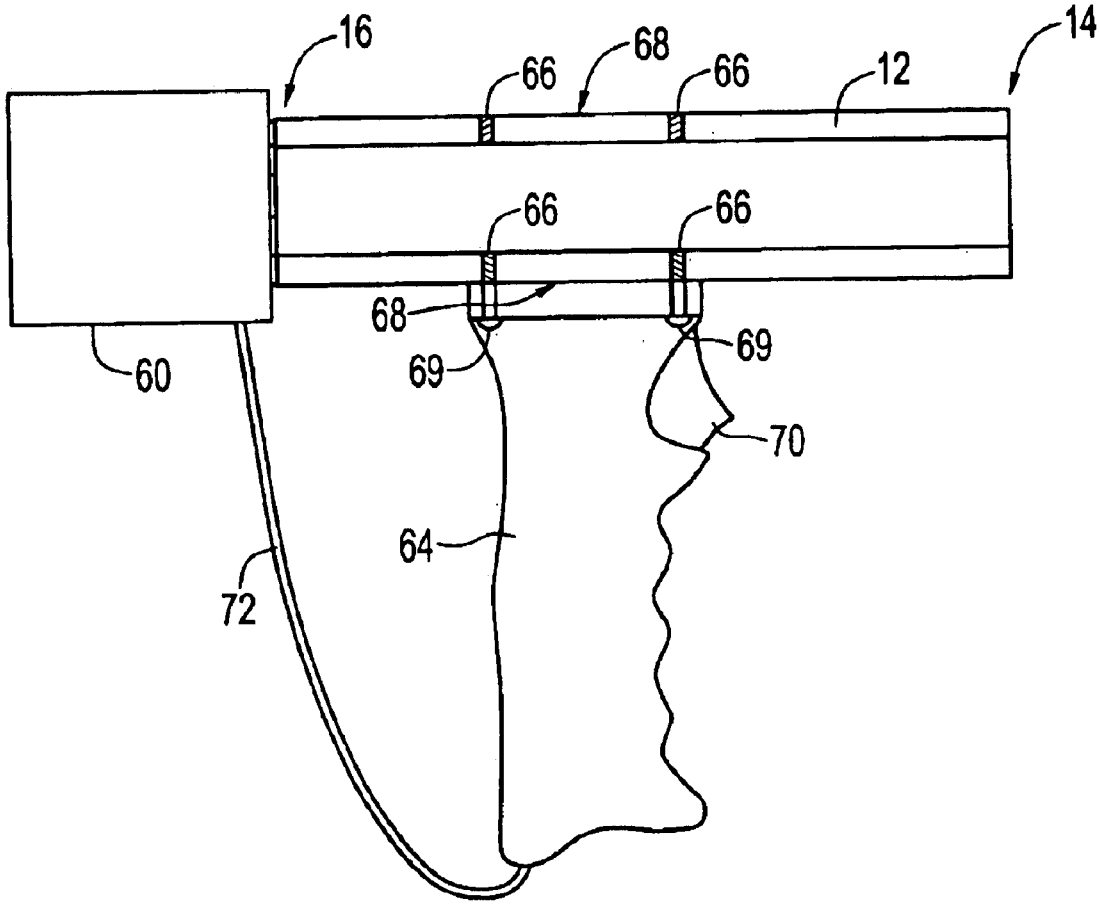
FIG. 4 shows a side elevation view of the frame of the cutting and crimping device of FIG. 1 with a grip attached thereto.

FIG. 4 shows frame 12 of cutting and crimping device 10 with grip 64 attached to flat portion 68, and drive means 60 coupled to back end 16. Frame 12 comprises threaded holes 66 in flat portion 68 to facilitate attachment of grip 64 to frame 12 by screws 69 or the like. Preferably, there are four threaded holes 66 on each side of frame 12, so that grip 64 may be attached to either side of frame 12. Grip 64 may comprise control button 70 which is connected by control wire 72 to control the operation of drive means 60.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A cutting and crimping device comprising:

(a) a frame with a front end and a back end, the frame comprising a protrusion on the front end, the protrusion being held stationary with respect to the frame and having a first cutting portion and a first crimping portion both immovably mounted on the opposed sides thereof;

(b) a cutting arm with a front end and a back end, the cutting arm pivotally coupled to the frame on one side of the protrusion, the cutting arm comprising a second cutting portion on its front end;

(c) a crimping arm with a front end and a back end, the crimping arm pivotally coupled to the frame on an opposite side of the protrusion, the crimping arm comprising a second crimping portion on its front end; and, (d) an actuator coupled to the back ends of the cutting and crimping arms, the actuator operable to move the cutting and crimping device between an open position wherein the front ends of the cutting and crimping arms are separated from the protrusion by a maximum distance, and a closed position wherein the front ends of the cutting and crimping arms are separated from the protrusion by a lesser distance.

2. The cutting and crimping device of claim 1 wherein the actuator comprises a push rod having a front end, a back end, and a block, the block attached to the front end of the push rod and coupled to each of the cutting and crimping arms.

3. The cutting and crimping device of claim 2 wherein the actuator is coupled to the back end of the cutting arm by a cutting arm link, with a back end of the cutting arm link being pivotally attached to the block, and a front end of the cutting arm link being pivotally attached to the back end of the cutting arm.

4. The cutting and crimping device of claim 3 wherein die actuator is coupled to the back end of the crimping arm by a crimping arm link, with a back end of the crimping arm link being pivotally attached to the block, and a front end of the crimping arm link being pivotally attached to the back end of the crimping arm.

5. The cutting and crimping device of claim 4 wherein the cutting arm link is longer than the crimping arm link.

6. The cutting and crimping device of claim 1 wherein the second cutting portion comprises a reversible cutting blade.

7. The cutting and crimping device of claim 1 wherein the protrusion comprises a recess sized slightly larger than the first cutting portion, and the first cutting portion comprises a cutting edge opposite a rounded edge, with the rounded edge positioned in the recess.

8. The cutting and crimping device of claim 1 wherein the first and second crimping portions comprise rounded notches.

9. The cutting and crimping device of claim 1 wherein when the cutting and crimping device is in the closed position, the first and second cutting portions are separated by approximately 0.2 mm.

10. The cutting and crimping device of claim 2 further comprising a drive means connected to the back end of the push rod, the drive means operable to urge the push rod forward.

11. The cutting and crimping device of claim 10 further comprising a handlebar attached to the frame.

12. The cutting and crimping device of claim 10 further comprising a grip attached to the frame.

13. The cutting and crimping device of claim 12 wherein the grip comprises a control button operable to control the drive means.

14. The cutting and crimping device of claim 2 wherein the actuator further comprises a plate attached to the back end of the push rod, further comprising a spring between the plate and the frame, the spring biasing the cutting and crimping device to the open position.

15. The cutting and crimping device of claim 14 further comprising a drive means connected to the plate, the drive means operable to urge the push rod forward.

* * * * *